US008833976B2

(12) United States Patent
Chi

(10) Patent No.: US 8,833,976 B2
(45) Date of Patent: Sep. 16, 2014

(54) LED LIGHTING DEVICE

(71) Applicant: The Light of the World International Co., Ltd., Kaohsiung (TW)

(72) Inventor: Po Wen Chi, Kaohsiung (TW)

(73) Assignee: The Light of the World International Co., Ltd., Kaohsiung (TW)

( * ) Notice: Subject to any disclaimer, the term of this patent is extended or adjusted under 35 U.S.C. 154(b) by 0 days.

(21) Appl. No.: 13/906,617

(22) Filed: May 31, 2013

(65) Prior Publication Data

US 2014/0226340 A1 Aug. 14, 2014

(30) Foreign Application Priority Data

Feb. 8, 2013 (TW) ..... 102203083 U

(51) Int. Cl.
*F21V 29/00* (2006.01)
*F21V 1/00* (2006.01)
*F21V 13/02* (2006.01)

(52) U.S. Cl.
CPC . *F21V 1/00* (2013.01); *F21V 13/02* (2013.01); *F21V 29/22* (2013.01)
USPC ..... 362/294; 362/249.02; 362/351; 362/360; 362/410

(58) Field of Classification Search
USPC ..... 362/249.01, 219.02, 294, 351, 352, 362/410, 414
See application file for complete search history.

(56) References Cited

U.S. PATENT DOCUMENTS

| | | | | |
|---|---|---|---|---|
| 6,616,298 | B1 * | 9/2003 | Bernhard | 362/650 |
| 8,454,202 | B2 * | 6/2013 | Markle et al. | 362/294 |
| 8,469,559 | B2 * | 6/2013 | Williams | 362/395 |
| 2012/0287642 | A1 * | 11/2012 | Zeng | 362/294 |

* cited by examiner

*Primary Examiner* — John A Ward
(74) *Attorney, Agent, or Firm* — Kolisch Hartwell, P.C.

(57) ABSTRACT

A LED lighting device comprises a lampshade, a thin aluminum heat dissipating plate, and a LED lighting component. The lampshade has an opening portion. The thin aluminum heat dissipating plate is provided with a supporting member perpendicular to the thin aluminum heat dissipating plate at a lower side portion or an upper side portion of the thin aluminum heat dissipating plate and being surrounded and covered by the lampshade. The LED lighting component includes a circuit board and a LED element provided on the circuit board to form a light emitting surface, the circuit board of the LED lighting component connected with the thin aluminum heat dissipating plate, the light emitting surface of the LED lighting component being faced toward the opening portion of the lampshade. Thus, a color changeable LED lighting device is provided.

9 Claims, 3 Drawing Sheets

LED LIGHTING DEVICE

CROSS-REFERENCE TO RELATED APPLICATION

This application claims priority to Taiwanese Patent Application No. 102203083, filed Feb. 8, 2013, which is hereby incorporated by reference.

FIELD OF THE INVENTION

The present invention relates to a lighting device with a lampshade, and more particularly to a LED lighting device with a lampshade.

BACKGROUND OF THE INVENTION

A conventional light bulb such as incandescent light bulb or energy saving light bulb scatters light in all directions, and the lighting area are broad. But the brightness of the scattering light is relatively not enough to be focusing and uniformed. Moreover, the scattering light tends to be incident upon human's eyes to bring uncomfortable. Therefore, a conventional lamp, such as table lamp or chandelier, is installed with a lampshade to obscure or reduce the intensity of the scattering light. With different styles, shapes, and translucent materials of lampshades, it creates a variety of temperament and interest.

With the advance of technology, there are more and more new lighting elements introduced. Among these new lighting elements, a LED lighting element has the advantages of low energy consumption, efficient energy saving, long duty-life, durability, and thus it gradually replaces the traditional lighting elements. Accordingly, LED bulbs are developed. Moreover, a LED lighting device with a lampshade is introduced.

However, since the LED bulb produces heat and requires a large cooling element, such as cooling fins for dissipating heat, therefore the whole LED bulb becomes thick and manufacturing cost thereof increases. Furthermore, because more than half space of LED light bulbs is occupied by a heat dissipating element which emits no light, therefore the light emitting on the lampshade is uneven, where there will show two regions with different brightness.

SUMMARY OF THE INVENTION

Therefore, an object of the present invention is to provide a LED lighting device using a lampshade in order to improve the problems above. A LED lighting device comprises a lampshade, a thin aluminum heat dissipating plate, and a LED lighting component. The lampshade has an opening portion. The thin aluminum heat dissipating plate formed as a flat plate member, being provided with a supporting member perpendicular to the thin aluminum heat dissipating plate at an lower side portion or an upper side portion of the thin aluminum heat dissipating plate and being surrounded and covered by the lampshade. The LED lighting component includes a circuit board and a LED element provided on the circuit board to form a light emitting surface, the circuit board of the LED lighting component connected with the thin aluminum heat dissipating plate, the light emitting surface of the LED lighting component being faced toward to the opening portion of the lampshade.

According to the present invention, further comprises a heat conducting tin layer or a heat conducting graphite layer provided between the thin aluminum heat dissipating plate and the LED lighting component.

According to the present invention, further comprises a tin layer provided between the circuit board and the LED element.

According to the present invention, the LED lighting component has a plurality of the LED elements.

According to the present invention, the distribution density of the LED elements of the LED lighting component in a periphery portion of the thin aluminum heat dissipating plate is higher than the distribution density of the LED elements of the LED lighting component in the central portion of the thin aluminum heat dissipating plate.

According to the present invention, the LED lighting component is an integrated LED.

According to the present invention, an opening area of the opening portion of the lampshade equals to or is greater than the area of the light emitting area.

According to the present invention, the LED lighting component is connected with the lower side portion or the upper side portion of the thin aluminum heat dissipating plate.

According to the present invention, an inner side surface of the lampshade is provided with a reflective layer.

According to the present invention, as compared with a conventional lamp having lampshade, the present invention achieves the same or better lighting effects by applying LED light-emitting characteristics. Accordingly, because of low power consumption, the present invention applies a thin aluminum heat dissipating plate as a cooling element, which possesses advantage of simple structure and low cost. Moreover, benefiting from the thin structure, the LED lighting device overcomes the problems of uneven illuminating area incident upon the lampshade. Thus, the advantages of LED lighting devices includes energy-saving, low producing costs, artistic values, high lighting effectiveness.

BRIEF DESCRIPTION OF THE DRAWINGS

The structure and the technical means applied by the present invention for achieving the above and other objects can be best understood by referring to the following detailed description of the preferred embodiments and the accompanying drawings.

DETAILED DESCRIPTION OF THE PREFERRED EMBODIMENTS

The detailed description of the invention which follows is made with reference to the drawings and in terms of a preferred embodiment of the invention. The detailed description is not intended to limit the scope of the present invention, and the only limitations intended are those embodied in the claims hereto.

Figure 1:
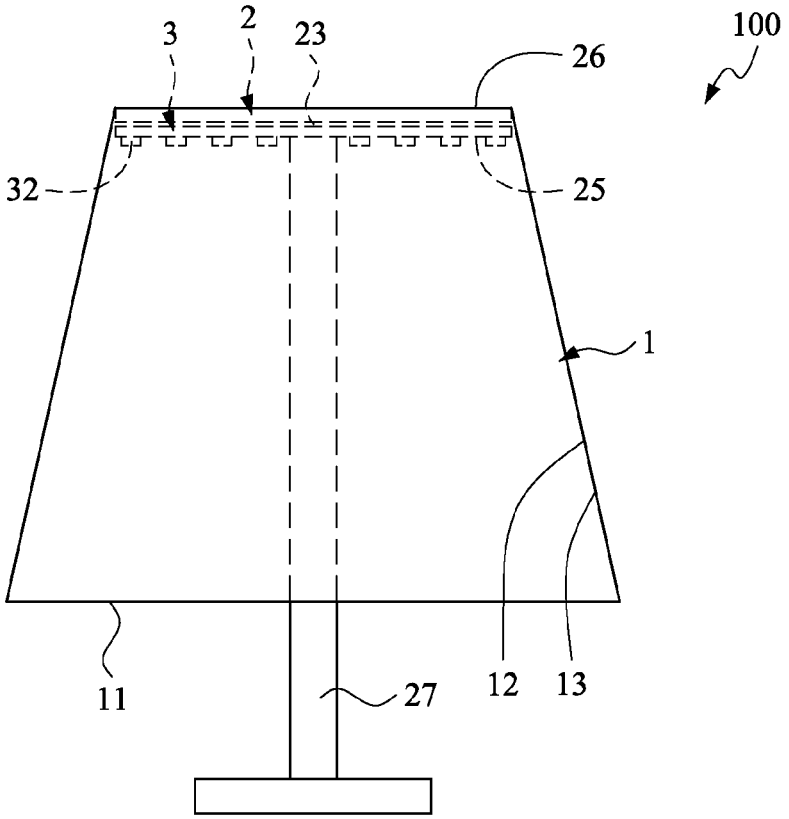
FIG. 1 is a schematic perspective view illustrating an embodiment of a LED lighting device according to the present invention.
Figure 2A:
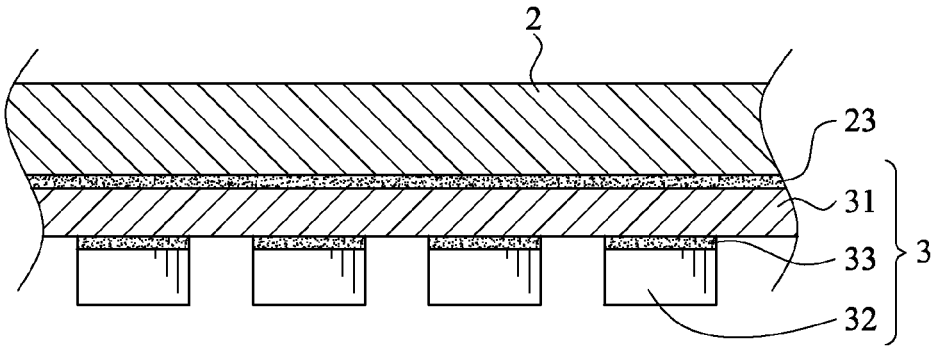
FIG. 2*a* is an enlarged sectional view illustrating a schematic part of an embodiment of a LED lighting device according to the present invention.

Please refer to FIG. 1 and FIG. 2*a*. A LED lighting device 100 according to the present invention includes a lampshade 1, a thin aluminum heat dissipating plate 2 and a LED lighting component 3.

Figure 2B:
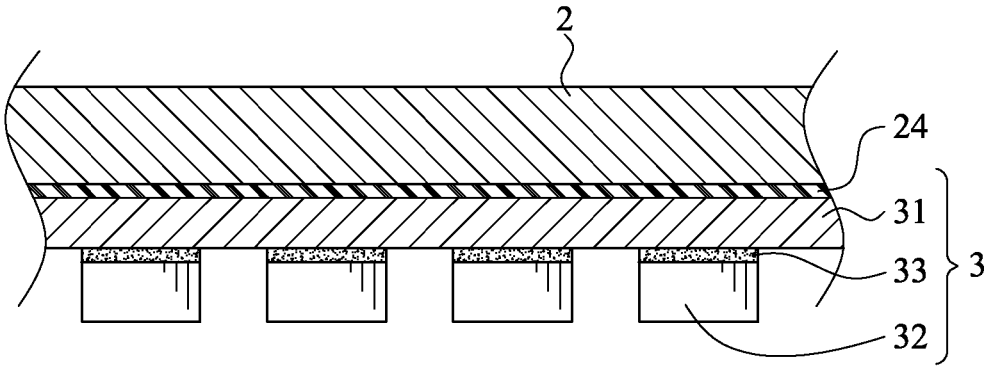
FIG. 2*b* is an enlarged sectional view illustrating a schematic part of an embodiment of a LED lighting device according to the present invention.
Figure 3:
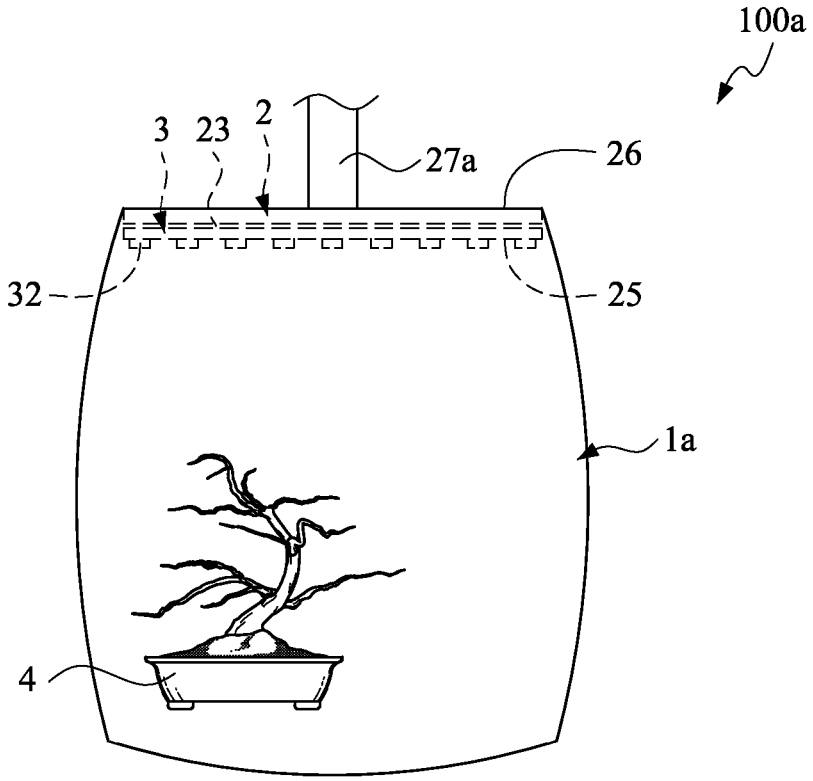
FIG. 3 is a schematic perspective view illustrating another embodiment of a LED lighting device according to the present invention.

The lampshade 1 has an opening portion 11. The thin aluminum heat dissipating plate 2 is formed as a flat plate member. A surface of the thin aluminum heat dissipating plate 2 has a heat conductive tin layer 23. The heat conductive tin layer 23 can enhance the heat of the LED light component 3 to transfer to the thin aluminum heat dissipating plate 2. The thin aluminum heat dissipating plate 2 is provided with a supporting member 27 perpendicular to the thin aluminum heat dissipating plate 2 at the central surface of a lower side portion 25 of the thin aluminum heat dissipating plate 2. The thin aluminum heat dissipating plate 2 is surrounded and covered by the lampshade 1. Please refer to FIG. 2*b*, showing another embodiment of the present invention, the heat conductive tin layer 23 can be replaced by a heat conductive graphite layer 24. Moreover, please refer to FIG. 3, showing other embodiment of the present invention, the thin aluminum heat dissipating plate 2 of LED lighting device 100*a* is provided with a supporting member 27*a* which is perpendicular to the thin aluminum heat dissipating plate 2 at the central surface of an upper side portion 26 of the thin aluminum heat dissipating plate 2. The thin aluminum heat dissipating plate 2 is surrounded and covered by the lampshade 1*a*. Further, the lampshade 1 has a translucent pattern portion 4. The LED lighting device can exhibit a pleasant and comfortable visual experience, so the LED lighting device can be used in different purposes.

A LED lighting component 3 includes a circuit board 31 and a LED element 32 provided on the circuit board 31 to form a light emitting surface for generating a surface lighting. The circuit board 31 of the LED lighting component 3 is connected with the heat conductive tin layer 23 or the heat conductive graphite layer 24 of the thin aluminum heat dissipating plate 2. The LED element 32 is welded with the circuit board 31 by a tin layer 33. The LED lighting component 3 is being provided on the lower side portion 25 of the thin aluminum heat dissipating plate 2. The light emitting surface of the LED light component 3 is provided to face the opening portion 11 of the lampshade 1. Moreover, in an embodiment of the present invention, the LED light component 3 includes a plurality of the LED elements 32. The LED elements 32 include SMD LEDs such as 5050/3528/5730/3014 SMD LEDs. Energy consumption of SMD LEDs is reduced by 80% as compared with the same lighting efficiency of the incandescent light bulb. In addition, SMD LEDs fades only 50% of the initial light after being used for 100,000 hours.

Preferably, the entire contact surface between the LED elements 32 and the circuit board 31 is coated with a solder paste. Then the LED elements 32 are welded with the circuit board 31. Accordingly, the LED elements 32 are connected to the circuit board 31 firmly. The thermal conductive effect of the tin layer 33 is good and steady without being deteriorate and harden even after a long time of use. The other side of the circuit board 31 is disposed in a way adjacent to one side of the thin aluminum heat dissipating plate 2. The heat conducting tin layer 23 or the heat conducting graphite layer 24 is provided between the circuit board 31 and the thin aluminum heat dissipating plate 2, with regard to the characteristics of graphite having a lower thermal resistance, higher thermal conductivity and poorer electrical conductivity than the metal. Furthermore, the graphite will not be deteriorate and harden after a long time of use.

Figure 4:
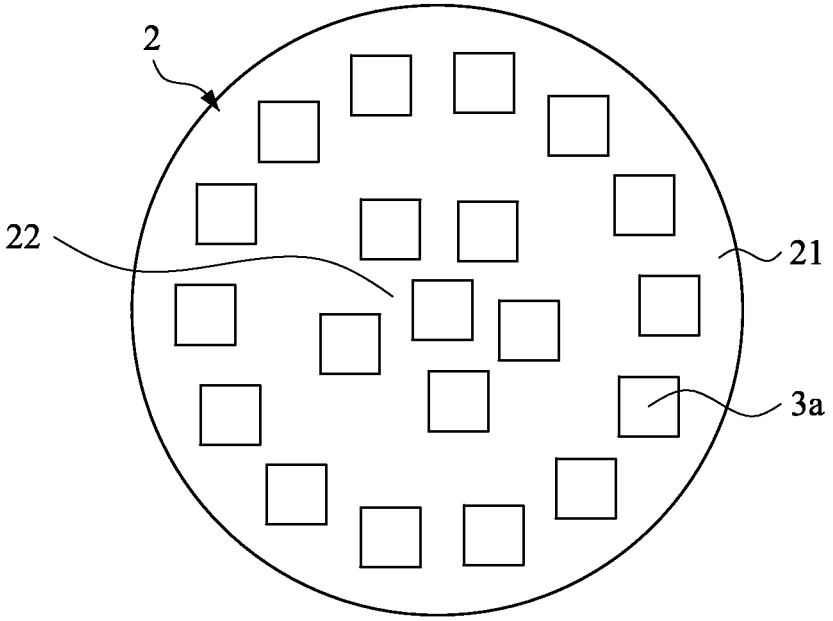
FIG. 4 is a schematic diagram illustrating another embodiment of LED light component of a LED lighting device according to the present invention.

An inner side surface 12 of the lampshade 1 is provided with a reflective layer 13. The reflective layer 13 is provided for enhancing light concentration and reducing light fade. Please refer to FIG. 4, in another embodiment of the present invention, the distribution density of the LED elements of the LED lighting component 3*a* in a periphery portion 21 of the thin aluminum heat dissipating plate 2 is higher than the distribution density of the LED elements of the LED light component in the central portion 22 of the thin aluminum heat dissipating plate 2. The light of the LED light source is projected uniformly toward of the opening portion 11.

Please refer to FIG. 1 and FIG. 3, an opening area of the opening portion 11 of the lampshade 1 equals to or is greater than the area of the light emitting area, to not only concentrate the LED light source, but also uniformly project light toward the opening 11. The area of light irradiation can also be expanded.

Figure 5:
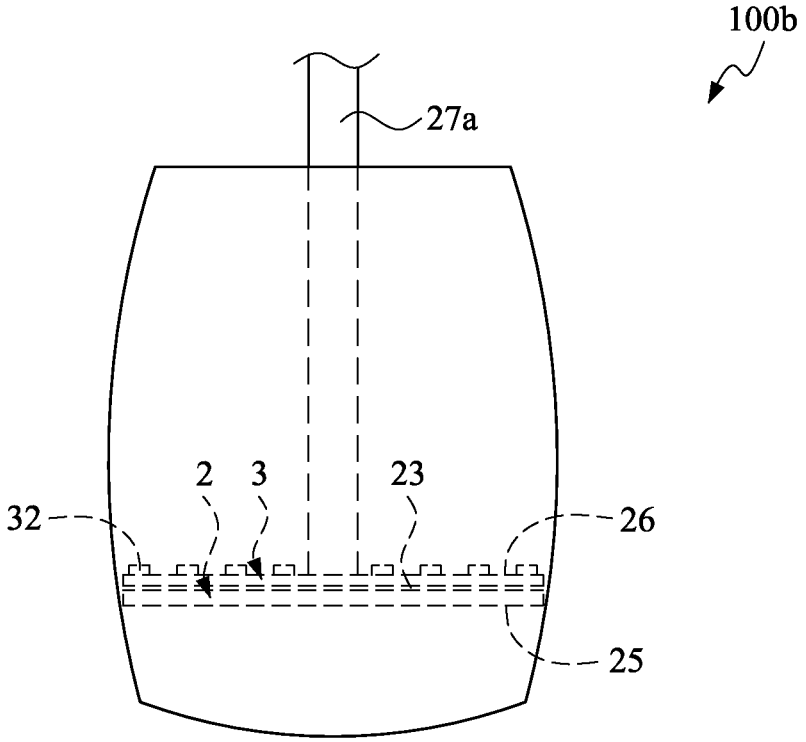
FIG. 5 is a schematic perspective view illustrating another embodiment of a LED lighting device according to the present invention.

Please refer to FIG. 5, in another embodiment of the present invention, the LED light component 3 is connecting with the upper side portion 26 of the thin aluminum heat dissipating plate 2, so the LED lighting device can display different styles and visual experiences.

The LED lighting device 100 according to the present invention further includes a color temperature controller. The color temperature controller outputs a corresponding pulse width modulation (PWM) signal to control either the current or the voltage of the LED lighting device 100, so that the LED lighting device 100 produces a same color temperature change to improve the color temperature control of the conventional LED lighting device. Thus a color changeable LED lighting device is provided.

The above description should be considered as only the discussion of the preferred embodiments of the present invention. However, a person skilled in the art may make various modifications to the present invention. Those modifications still fall within the spirit and scope defined by the appended claims.

What is claimed is:

1. A LED lighting device, comprising:

a lampshade having an opening portion;

a thin aluminum heat dissipating plate, formed as a flat plate member, being provided with a supporting member perpendicular to the thin aluminum heat dissipating plate at an lower side portion or an upper side portion of the thin aluminum heat dissipating plate and being surrounded and covered by the lampshade; and a LED lighting component including a circuit board and a LED element provided on the circuit board to form a light emitting surface, the circuit board of the LED lighting component connected with the thin aluminum heat dissipating plate, the light emitting surface of the LED lighting component being faced toward the opening portion of the lampshade.

2. The LED lighting device as claimed in claim 1, further comprising a heat conducting tin layer or a heat conducting graphite layer provided between the thin aluminum heat dissipating plate and the LED lighting component.

3. The LED lighting device as claimed in claim 1, further comprising a tin layer provided between the circuit board and the LED element.

4. The LED lighting device as claimed in claim 3, wherein the distribution density of the LED elements of the LED lighting component in a periphery portion of the thin aluminum heat dissipating plate is higher than the distribution density of the LED elements of the LED lighting component in the central portion of the thin aluminum heat dissipating plate.

5. The LED lighting device as claimed in claim 1, wherein the LED lighting component has a plurality of the LED elements.

6. The LED lighting device as claimed in claim 1, wherein the LED lighting component is an integrated LED.

7. The LED lighting device as claimed in claim 1, wherein an opening area of the opening portion of the lampshade equals to or is greater than the area of the light emitting area.

8. The LED lighting device as claimed in claim 1, wherein the LED lighting component is connected with the lower side portion or the upper side portion of the thin aluminum heat dissipating plate.

9. The LED lighting device as claimed in claim 1, wherein an inner side surface of the lampshade is provided with a reflective layer.

* * * * *